US008215125B2

(12) United States Patent
Linder

(10) Patent No.: US 8,215,125 B2
(45) Date of Patent: Jul. 10, 2012

(54) REFREEZABLE ICE BARREL

(75) Inventor: Nathan Linder, West Covina, CA (US)

(73) Assignee: Innovative Displayworks, Inc., San Dimas, CA (US)

( * ) Notice: Subject to any disclaimer, the term of this patent is extended or adjusted under 35 U.S.C. 154(b) by 137 days.

(21) Appl. No.: 12/490,243

(22) Filed: Jun. 23, 2009

(65) Prior Publication Data

US 2010/0319386 A1 Dec. 23, 2010

(51) Int. Cl.
*F25D 3/08* (2006.01)

(52) U.S. Cl. ..... 62/457.2; 62/371

(58) Field of Classification Search ..... 62/457.2, 62/457.3, 457.8, 457.9, 530, 371
See application file for complete search history.

(56) References Cited

U.S. PATENT DOCUMENTS

| | | | | |
|---|---|---|---|---|
| 2,572,508 | A | 3/1940 | Muffly | |
| 3,491,548 | A | 1/1968 | Christiansen | |
| 4,546,900 | A | 10/1985 | Lackey | |
| 4,724,682 | A | 2/1988 | Flum et al. | |
| 5,048,171 | A | 9/1991 | Bidwell et al. | |
| 5,201,194 | A * | 4/1993 | Flynn et al. | 62/457.3 |
| 6,269,653 | B1 | 8/2001 | Katusa | |
| RE37,696 | E | 5/2002 | Parker | |
| 6,925,834 | B2 | 8/2005 | Fuchs | |
| 7,444,825 | B2 | 11/2008 | Miller et al. | |
| 2003/0010054 | A1 * | 1/2003 | Esch et al. | 62/354 |
| 2006/0168985 | A1 * | 8/2006 | Gano | 62/371 |

OTHER PUBLICATIONS

Response to Office Action dated Feb. 14, 2011 in relation to U.S. Appl. No. 12/940,946.

* cited by examiner

*Primary Examiner* — Melvin Jones
(74) *Attorney, Agent, or Firm* — Stetina Brunda Garred & Brucker

(57) ABSTRACT

Provided is a refreezable barrel for chilling a plurality of items. The refreezable barrel includes a cooler body defining an open end and a closed end portion. The cooler body defines a cavity extending from the open end towards the closed end portion. The cavity is configured to receive the plurality of items. A cooling element is disposed within the cooler body and is refreezable to mitigate temperature rise within the cooler body. The refreezable barrel also includes a cooler stand defining a recess configured to engage with the closed end portion of the cooler body.

16 Claims, 4 Drawing Sheets

REFREEZABLE ICE BARREL

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to ice barrels adapted for holding ice and beverages and, more particularly, to ice barrels configured to reduce the amount of ice required to chill the beverages over an extended period of time.

Ice barrel containers or "beverage containers" are well-known in the art and are commonly utilized at retail markets, sporting events, and promotional events. The ice barrels are typically used to chill beverages at a location which typically does not offer refrigerated cooling. For instance, the ice barrels are frequently located close to check-out counters to entice purchases by departing customers.

The ice barrels generally include a receptacle having an open top, a bottom wall, and a continuous upright sidewall extending between the open top and the bottom wall to from an interior cavity. The interior cavity is generally sized to hold a plurality of beverages, i.e., soft drinks or beer in cans or bottles. It is generally desirable for the beverages to be served at a chilled temperature. Therefore, ice may also be placed within the cavity to chill the beverages.

Over time, the ice within the ice barrel melts, leaving a large volume of water. In order to keep the beverages chilled, the water is generally removed from the ice barrel and the barrel is refilled with fresh ice. However, the ice barrel may be positioned in a location which may not accommodate removal of the water from the barrel. For instance, if the ice barrel is placed at a checkout counter in a convenience store, the ice barrel is generally moved to an outdoor location or a location having a drain in order to remove the water from the interior cavity. Once the water is removed, the ice barrel may be refilled with ice to keep the beverages at a chilled temperature.

Although conventional ice barrels may allow the beverages to be maintained in a chilled temperature, the conventional ice barrels may be inefficient. For instance, the ice barrel may be filled with ice on numerous occasions in order to maintain the beverages at a chilled temperature. As such, the process of removing the water and refilling the ice barrels with ice may consume large amounts of water. In view of the importance of water conservation, it is typically desirable to limit the amount of ice used in the ice barrels. Furthermore, as was mentioned above, the process of draining the water from the interior cavity and refilling the ice barrel with ice may require movement of the ice barrel. Given the amount of water and beverages which may be located within the barrel, movement of the ice barrel may be a strenuous endeavor.

As is apparent from the foregoing, there exists a need in the art for an ice barrel configured to reduce the amount of ice required to chill beverages over an extended period of time. The present invention address this particular need, as will be discussed in more detail below.

BRIEF SUMMARY

Provided is a refreezable barrel configured to reduce the amount of ice used to chill beverages over an extended period of time. In this manner, the refreezable barrel may require fewer ice refills and may provide a more environmentally friendly alternative to conventional ice barrels.

The refreezable barrel includes a cooler body defining an open end and a closed end portion. The cooler body defines a cavity extending into the cooler body from the open end towards the closed end portion. The cavity is configured to receive a plurality of items, such as ice and beverages. A cooling element is disposed within the cooler body and is refreezable to mitigate temperature rise within the cooler body. The refreezable barrel also includes a cooler stand defining a recess configured to engage with the closed end portion of the cooler body.

The refreezeable barrel may advantageously be chilled to freeze/chill the refreezeable elements before ice is placed within the cooler body. By freezing/chilling the cooler body, the temperature difference between the cooler body and the ice may be reduced. Consequently, the ice may last for a longer period of time before it melts, which may reduce the overall amount of ice used to chill the beverages. To facilitate that end, the refreezable ice barrel may have integrated therein an ice maker or refrigerator unit to produce ice or otherwise maintain refrigerated temperatures.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
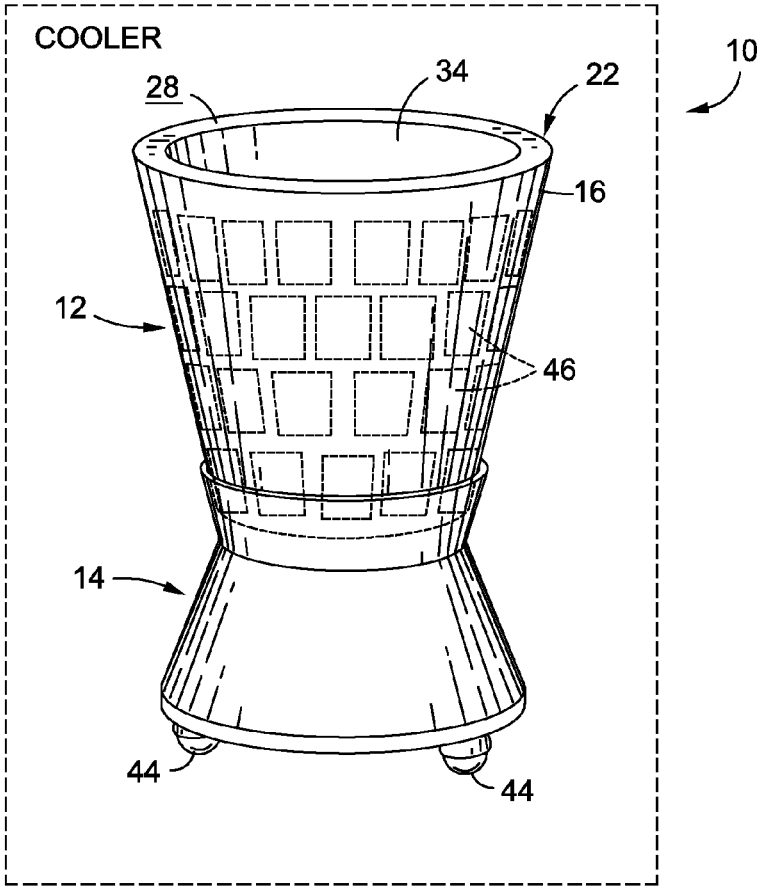
FIG. 1 is an upper perspective view of a refreezable barrel including a refreezable cooler body and a cooler stand.

Referring now to the drawings, wherein the showings are for purposes of illustrating a preferred embodiment of the present invention only, and not for purposes of limiting the same, FIG. 1 illustrates one embodiment of a refreezable barrel 10. The refreezable barrel 10 includes a cooler body 12 and a cooler stand 14. The cooler body 12 is disposable on the cooler stand 14 to facilitate movement of the cooler body 12. Ice may be disposed within the cooler body 12 to chill food items and/or beverages. The cooler body 12 is refreezable to prolong the melting of ice disposed within the cooler body 12. In this manner, the cooler body 12 may reduce the amount of ice needed to keep food and/or beverages at a chilled temperature. As such, the refreezable barrel 10 may provide an environmentally friendly alternative to conventional ice barrels Referring now to FIG. 2, the cooler body 12 includes a cooler sidewall 16 and a cooler base 18. The cooler body 12 defines a closed end portion 20 adjacent the cooler base 18 and an open end 22 opposite the cooler base 18. In the embodiment depicted in FIG. 2, the cooler sidewall 16 defines a diameter that increases from the cooler base 18 toward the open end 22. However, it is understood that the cooler sidewall 16 may define a non-circular shape without departing from the spirit and scope of the present invention. The cooler sidewall 16 includes a sidewall inner surface 24, a sidewall outer surface 26, and a sidewall upper surface 28 extending between the sidewall inner surface 24 and the sidewall outer surface 26 adjacent the open end 22 of the cooler body 12. The cooler base 18 defines a cooler base inner surface 30 and a cooler base outer surface 32. The cooler base inner surface 30 and sidewall inner surface 24 collectively define a cavity 34 which extends into the cooler body 12 from the open end 22 towards the cooler base 18.

The refreezable barrel 10 may additionally include a cooler stand 14 for supporting the cooler body 12. The cooler stand 14 includes a stand base 36 and a stand sidewall 38 protruding from the stand base 36. The stand sidewall 38 includes a sidewall inner surface 40 defining a stand recess 42. The stand recess 42 is sized and configured to receive the closed end portion 20 of the cooler body 12 to support the cooler body 12. In the embodiment depicted in FIG. 2, the cooler base outer surface 32 and a portion of the cooler sidewall outer surface 26 engage with the stand sidewall inner surface 40 when the cooler body 12 is seated on the cooler stand 14. The cooler stand 14 may additionally include one or move movement elements 44, such as wheels, to facilitate movement of the cooler stand 14. It is also contemplated that the movement elements 44 may be connected directed to the cooler body 12.

Figure 2:
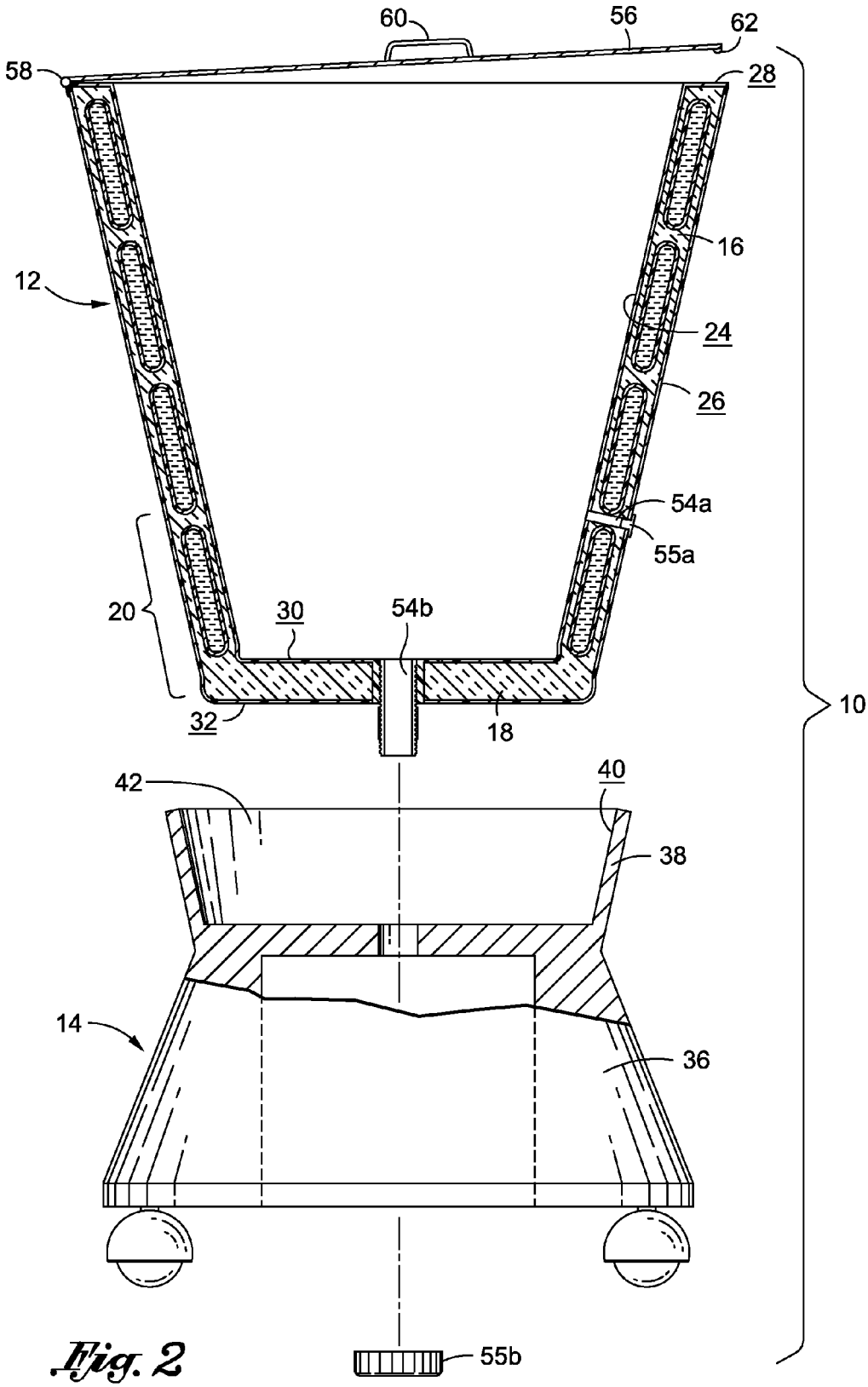
FIG. 2 is a side sectional view of a refreezable barrel having a lid, an upper drain and a lower drain.

The cooler stand 14 depicted in FIG. 2 includes a sidewall inner surface 40 which supports the cooler base outer surface 32. However, it is also contemplated that the cooler stand 14 may include an opening which receives the closed end portion 20 of the cooler body 12 and circumferentially engages with the cooler body 12.

The refreezable barrel 10 further includes one or more refreezable cooling element(s) 46 disposed within the cooler body 12. The cooling element 46 is freezeable/chillable to chill the cooler body 12 to prolong the melting of ice disposed within the cooler body 12. In other words, the temperature difference between the temperature of the cooler body 12 and the melting temperature of the ice may be reduced to prolong the lifespan of the ice. In this regard, the cooler body 12 may be disposed in a remote, non-refrigerated location (i.e., adjacent a counter at a convenience store or in a stadium) at a chilled temperature. Therefore, when ice and beverages are disposed within the cavity 34, the initial chilled temperature of the cooler body 12 prolongs melting of the ice. Instead of the ice and beverages being disposed within a ice barrel at an elevated temperature (i.e., at a temperature well above the freezing point of ice), the cooler body 12 is freezeable to a temperature at or near the freezing point of the ice to extend the melting period of the ice. As used herein, the melting period is defined as the time period beginning when a quantity of ice is disposed within the refreezable barrel 10 and ending when the all of the quantity of ice has melted.

In the particular embodiment illustrated in FIGS. 1 and 2, the cooler body 12 includes a plurality of cooling elements 46 disposed within the cooler sidewall 16. Cooling elements 46 may additionally be disposed within the cooler base 18. The cooling elements 46 are disposed in spaced relation relative to each other. The cooling elements 46 may include refrigerants commonly used in the art, such as liquid or gel refrigerants. The refrigerant may be repeatedly chilled or frozen to extend the melting period of the ice disposed within the cavity 34. The refrigerant may be disposed within an outer shell to separate the refrigerant from the cooler body 12.

Figure 3:
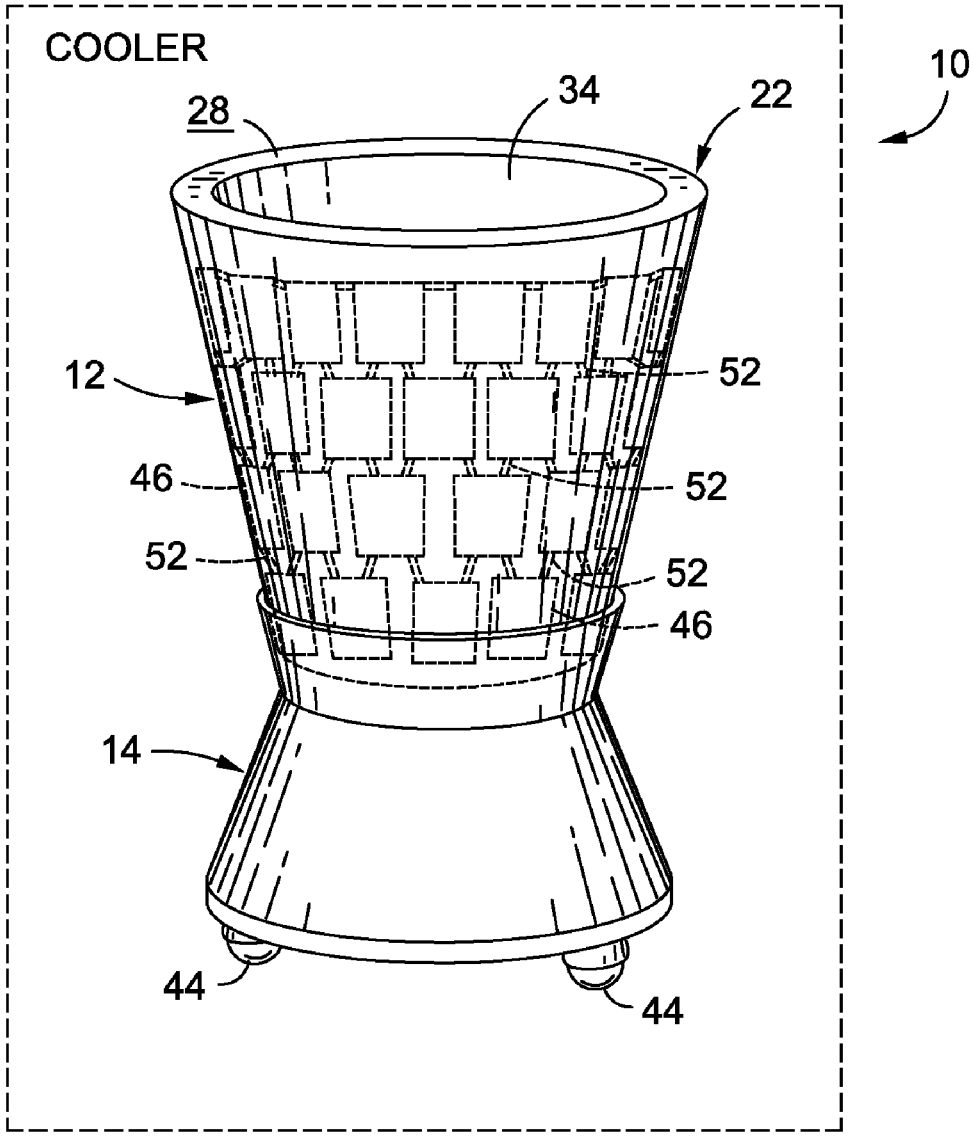
FIG. 3 is a side sectional view of a refreezable barrel having a plurality of fluidly interconnected cooling elements.

The cooling elements 46 may be integrally formed within the cooler body 12. In this manner, the cooling elements 46 may be molded within the cooler body 12 during formation of the cooler body 12 to enclose the refrigerant within the cooler body 12. According to another embodiment, and referring now specifically to the embodiment illustrated in FIGS. 3 and 4, the refrigerant may be added to the cooler body 12 after the formation of the cooler body 12. For instance, the cooler body 12 may be manufactured with one or more pockets 48 formed therein. The pocket(s) 48 may be sized and configured to receive the refrigerant after manufacture of the cooler body 12. In this manner, the pocket(s) 48 may include an access channel 50 extending through the cooler sidewall 16 to allow a liquid or gel refrigerant to be disposed into the pocket(s) 48. In the embodiment depicted in FIG. 3, the cooler body 12 includes a plurality of pockets 48 which are fluidly connected via fluid passageways 52 to disperse the refrigerant through the cooler body 12.

The refrigerant disposed within the cooler body 12 may include liquids or gels commonly used in the art. It is also contemplated that water/ice may be used to cool the cooler body 12. Referring now to the embodiment depicted in FIG. 4, the cooler body 12 includes a single cooling element 46 disposed within the cooler sidewall 16. The cooler sidewall 16 includes a single pocket 48 which circumnavigates the cooler cavity 34. Given the large area of the cooling element 46 in the embodiment illustrated in FIG. 4, relative to the cooling elements 46 depicted in FIGS. 1-3, it may be desirable to use water as the refrigerant. In this manner, water may be disposed within the pocket 48 formed within the cooler body 12. Subsequently, the cooler body 12 may be disposed within a freezer to chill or freeze the water. It is understood that water expands when it is frozen; therefore, the pocket 48 may not be completely filled with water to accommodate the expansion upon freezing. The expansion may also be accommodated by forming the cooler body 12 from a flexible material capable of withstanding the expansion.

Although the cooler body 12 may be configured to prolong the melting of ice disposed within the cavity 34, at some point, the ice will likely melt leaving water in the cavity 34. The cooler body 12 may include one or more drains 54 formed therein to facilitate removal of the water from the cavity 34. The drains 54 extend from the sidewall inner surface 24 to the sidewall outer surface 26. The drains 54 may also extend from the base inner surface 30 to the sidewall outer surface 26 or base outer surface 32. The drains 54 may include plugs 55 to restrict fluid flow through the drains 54. As shown in FIG. 2, the cooler body 12 includes two drains 54, namely an upper drain 54*a* and a lower drain 54*b* having respective plugs 55*a* and 55*b*. The upper drain 54*a* may be used initially to drain a portion of the cavity 34. Partial draining of the cavity 34 may be desirable to facilitate movement of the cooler body 12. However, the entire cavity 34 may be drained via the lower drain 54*b*.

Various implementations of the refreezable barrel 10 may include a lid 56 disposable over the open end 22 of the cooler body 12. The lid 56 may temporarily cover the open end 22 of the cooler body 12 to prevent foreign objects or debris from entering the cavity 34. The lid 56 may be connected to the cooler body 12 via a hinge 58 to enable pivotal movement of the lid 56 relative to the cooler body 12 between an open position and a closed position. In the closed position, the cavity 34 is substantially covered by the lid 56. As the lid 56 moves from the closed position toward the open position, the cavity 34 becomes uncovered.

Figure 4:
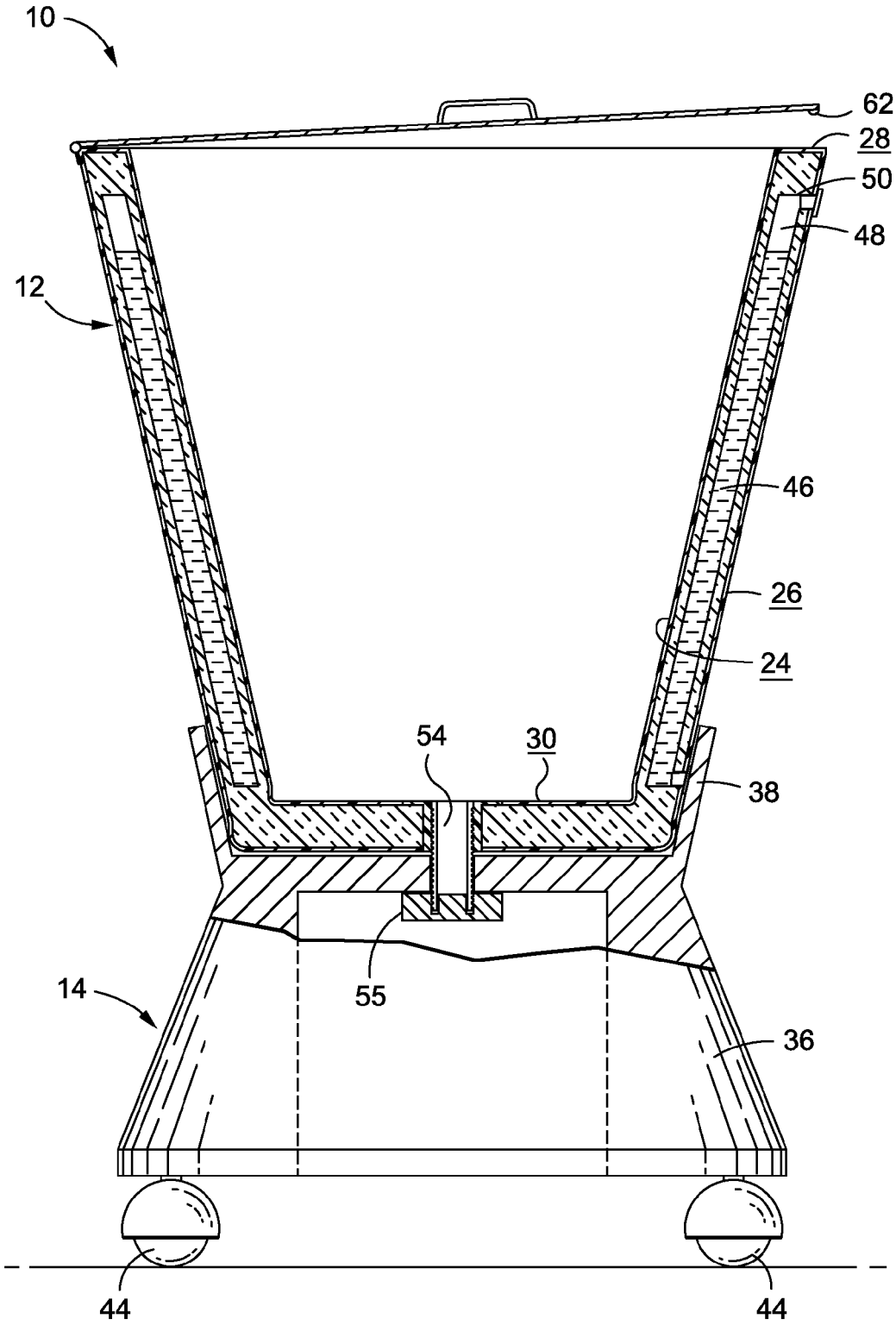
FIG. 4 is a side sectional view of a refreezable barrel having a single cooling element.

The lid 56 may include a handle 60 to facilitate movement of the lid 56 between the open and closed positions. The lid 56 may further include a seal 62 which engages with the cooler body 12 when the lid 56 is in the closed position to create a substantially air-tight seal between the lid 56 and the cooler body 12 when the lid 56 is in the closed position. Although FIGS. 2 and 4 depicts the seal 62 on the lid 56, it is understood that the seal 62 may be disposed on the cooler body 12 for engagement with the lid 56 when the lid 56 is placed in the closed position.

Figure 5:
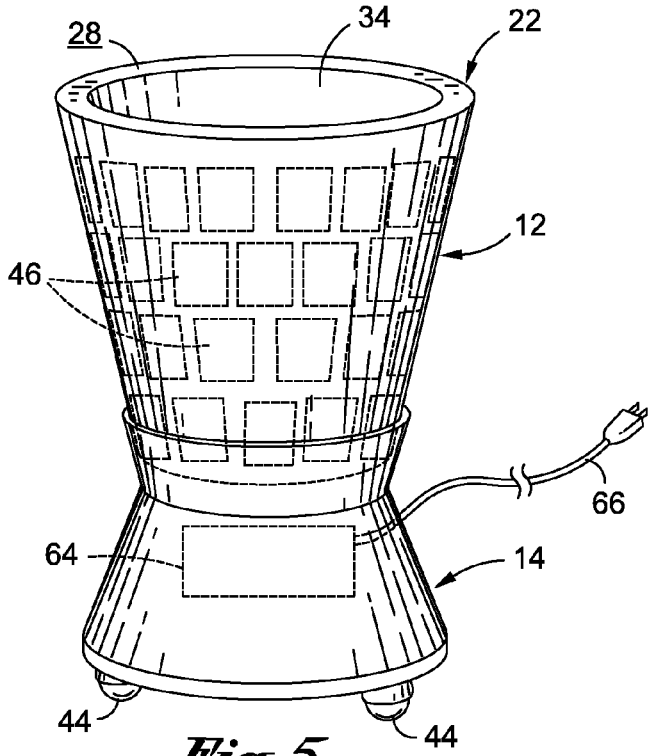
FIG. 5 is an upper perspective view of a refreezable barrel having an ice maker disposed within a cooler stand.

As stated above, the refreezable barrel 10 may be filled with ice to chill beverages for an extended period of time. To this end, one embodiment of the refreezable barrel 10 includes an ice maker or refrigeration unit 64 disposed therein. As depicted in FIG. 5, the ice maker or refrigeration unit 64 is disposed within the cooler stand 14. By disposing the ice maker or refrigeration unit 64 within the cooler stand 14, the cooler body 12 may be easily filled with ice. The ice maker or refrigeration unit 64 may be battery powered, or receive power from an electrical outlet via a power chord 66.

The ice maker or refrigeration unit 64 may be connected to a water input, or the cooler stand 14 may include a water reservoir disposed therein. As ice is produced by the ice maker 64, the ice may fall into an ice storage chamber within the cooler stand 14. The cooler stand 14 may further include an access door which may be opened or closed to provide access to the ice storage chamber.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A refreezable barrel for chilling a plurality of items, the refreezable barrel being configured for use with ice, the refreezable barrel comprising:

a cooler body defining an open end and a closed end portion, the cooler body having a cavity extending from the open end towards the closed end portion, the cavity being configured to receive the plurality of items and the ice;

a cooling element disposed within the cooler body, the cooling element being refreezable to mitigate temperature rise within the cooler body to mitigate melting of the ice disposed within the cooler body for conserving water;

a cooler stand defining a recess configured to engage with the closed end portion of the cooler body; and an ice maker disposed within the cooler stand.

2. The refreezable barrel recited in claim 1, wherein the cooler body includes a cooler pocket disposed within the cooler body, the cooling element being disposed within the cooler pocket.

3. The refreezable barrel recited in claim 2, wherein the cooler pocket is an annular chamber.

4. The refreezable barrel recited in claim 1, wherein the cooler body includes a plurality of cooler pockets disposed within the cooler body, the refreezable barrel including a plurality of cooling elements, each cooling element being disposed within a respective one of the plurality of cooler pockets.

5. The refreezable barrel recited in claim 1, further including a bore and a valve, the bore extending through the cooler body adjacent the closed end portion, the valve being in fluid communication with the bore for controlling fluid flow through the bore.

6. The refreezable barrel recited in claim 1, further including a movement member connected to the cooler stand for facilitating movement of the cooler stand.

7. The refreezable barrel recited in claim 6, wherein the movement member includes a plurality of wheels.

8. The refreezable barrel recited in claim 1, further including a lid engageable with the cooler body, the lid being moveable between an open position and a closed position relative to the cooler body, the cavity being substantially covered when the lid is in the closed position, the cavity becoming exposed as the lid moves from the closed position toward the open position.

9. The refreezable barrel recited in claim 1, wherein the cooler stand circumferentially engages the cooler body.

10. A refreezable barrel for chilling a plurality of items, the refreezable barrel comprising:

a cooler body defining an open end and a closed end portion, the cooler body having;

a cavity extending from the open end towards the closed end portion, the cavity being configured to receive the plurality of items; and a bore extending through the cooler body adjacent to the closed end portion;

a cooling element disposed within the cooler body, the cooling element being refreezable to mitigate temperature rise within the cooler body; and a valve in fluid communication with the bore for controlling fluid flow through the bore.

11. The refreezable barrel recited in claim 10, wherein the cooler body includes a cooler pocket disposed within the cooler body, the cooling element being disposed within the cooler pocket.

12. The refreezable barrel recited in claim 11, wherein the cooler pocket is an annular chamber.

13. The refreezable barrel recited in claim 10, wherein the cooler body includes a plurality of cooler pockets disposed within the cooler body, the refreezable barrel including a plurality of cooling elements, each cooling element being disposed within a respective one of the plurality of cooler pockets.

14. The refreezable barrel recited in claim 10, further including a lid engageable with the cooler body, the lid being moveable between an open position and a closed position relative to the cooler body, the cavity being substantially covered when the lid is in the closed position, the cavity becoming exposed as the lid moves from the closed position toward the open position.

15. The refreezable barrel recited in claim 10, wherein the cooler stand circumferentially engages the cooler body.

16. A refreezable barrel comprising:

a cooler body having;

a cooler sidewall;

a cooler base, the cooler sidewall and cooler base collectively defining a cooler cavity; and a bore extending through the cooler body adjacent the closed end portion;

a cooling element disposed within the cooler body, the cooling element being refreezable to chill the cooler body;

a valve in fluid communication with the bore for controlling fluid flow through the bore.

* * * * *